US007337753B2

(12) United States Patent
Rees et al.

(10) Patent No.: US 7,337,753 B2
(45) Date of Patent: Mar. 4, 2008

(54) WATER HEATER

(75) Inventors: Richard Rees, Moorabbin (AU); Glenn Puddy, Moorabbin (AU)

(73) Assignee: Aqua Max Pty Ltd., Moorabbin, Victoria (AU)

( * ) Notice: Subject to any disclaimer, the term of this patent is extended or adjusted under 35 U.S.C. 154(b) by 316 days.

(21) Appl. No.: 11/098,174

(22) Filed: Apr. 4, 2005

(65) Prior Publication Data

US 2005/0217612 A1 Oct. 6, 2005

(30) Foreign Application Priority Data

Apr. 5, 2004 (AU) ..... 2004901781

(51) Int. Cl.
*F24H 1/00* (2006.01)

(52) U.S. Cl. ..... 122/18.1

(58) Field of Classification Search ..... 122/18.1, 122/14.31, 17.1, 18.4
See application file for complete search history.

(56) References Cited

U.S. PATENT DOCUMENTS 3,490,420 A * 1/1970 Kramer ..... 122/17.2
4,280,450 A * 7/1981 Maruyama ..... 122/13.01
5,357,907 A * 10/1994 Moore et al. ..... 122/14.22
5,361,729 A 11/1994 Trihey
5,499,621 A * 3/1996 Trihey ..... 122/17.1
6,237,544 B1 5/2001 Croxford et al.
6,318,304 B1 * 11/2001 Teschner ..... 122/18.1
6,378,777 B1 * 4/2002 Valcic et al. ..... 237/8 R

FOREIGN PATENT DOCUMENTS

EP 0 043 232 1/1982

* cited by examiner

*Primary Examiner*—Gregory Wilson
(74) *Attorney, Agent, or Firm*—Greer, Burns & Crain, Ltd.

(57) ABSTRACT

The water heater includes a burner and a water tank. Combustion products flow upwardly around the tank through a combustion products path where heat transfer to water in the tank occurs, the path being defined between the outer wall of the tank and a surrounding heat exchanger wall. The combustion products pass through outlet at the upper end of wall, and enter the flue which includes a down flow passage and then pass out through discharge outlet. The down flow passage is defined between a flue outer wall and a thermally conductive partition defining the inner wall of the passage. The partition is adjacent a heated zone of the water heater where stored heat of the water heater is available during quiescent or standby periods when the burner is not operating. The partition between the heated zone and the down flow passage provides a heat transfer path so that heat in the heated zone can transfer through the partition to gases in the down flow passage. This will assist or promote the functioning of the down flow passage as a heat trap during quiescent or standby periods when the burner is not operating.

13 Claims, 2 Drawing Sheets

WATER HEATER

FIELD OF THE INVENTION

This invention relates to water heaters, particularly water heaters for domestic or commercial use.

BACKGROUND OF THE INVENTION

Some known domestic and commercial water heaters include flue paths which include downwardly extending legs. For example, in patent specification U.S. Pat. No. 6,237,544, there is a downdraft passage for flue gases. In this apparatus, the downdraft passage is intended to operate as a heat trap when the burner is not operating thereby reducing the loss of heat from the apparatus by convective flow or leakage of heated gases through the flue outlet during such quiescent or standby times. However such heat loss does nevertheless occur.

It is an object of the present invention to provide a water heater of the kind which uses burning of fuel to generate combustion products which are used to heat water and which has features to reduce heat loss from the water heater during quiescent or standby times when the burner is not operating.

SUMMARY OF THE INVENTION

According to the present invention there is provided a water heater which in use is supplied with water to be heated, in which the supplied water is heated, and which stores heated water to be drawn therefrom, the water heater including:

a burner for burning a fuel such as a fuel gas (or liquid fuel), a combustion products path through which combustion products from the burner flow and transfer heat to the water which is in use supplied to the water heater and which is to be drawn from the water heater, a heated zone where heat within the water heater is available during periods when the burner is not operating, a down flow passage leading to a discharge outlet, the combustion products flowing in use in a downwards direction from the combustion products path through the down flow passage in passing to the discharge outlet, and a thermal transfer path from the heated zone to the down flow passage so that heat in the heated zone transfers through the transfer path to gases in the down flow passage when the burner is not operating, thereby promoting a heat trap effect in the down flow passage.

In the preferred embodiment the thermal transfer path comprises a thermally conductive partition located between the heated zone and the down flow passage so that heat in the heated zone transfers through the partition to gases in the down flow passage when the burner is not operating.

By providing for transfer of heat (through the partition in the preferred embodiment) to the gases in the down flow passage when the burner is not operating, the gases in the down flow passage can be hotter than they would otherwise be during the periods when the burner is not operating, thereby enhancing or promoting the heat trap effect resisting outflow of hot combustion products or other heated gases through the discharge outlet. This deliberate design for heat transfer outwardly from the water heater and particularly from areas or zones which are normally thermally insulated to prevent or retard heat loss is directly contrary to conventional design and construction of combustion products flues. Indeed, the deliberate provision for allowing heat transfer outwardly from the heater to the gases in the flue downstream from the point where the heated combustion products have finished performing their function of transferring heat to water, may seem contrary to good design for thermal efficiency. However, tests have indicated that the thermal losses from the water heater adopting the features of the present invention, can have improved heat retention during the quiescent or standby periods when the burner is not operating and this is believed due to the improved heat trap effect created in the down flow passage.

In a preferred water heater construction the heated zone is part of the combustion products path so that the combustion products flow through the heated zone when the burner is operating and where heat exchange from combustion products to the water occurs. The water heater may include a water tank and the burner is located at or beneath the bottom of the tank so that combustion products flow upwardly around the tank through the combustion products path where heat transfer to water in the tank occurs, the combustion products path being defined between an outer wall of the tank and a surrounding heat exchanger wall, the water heater further including an outlet near an upper end of the heat exchanger wall and through which combustion products pass before entering the down flow passage whereby, during operation of the burner, the combustion products flow along the outside of the wall of the tank thereby heating water in the tank and the combustion products pass through the outlet and flow into and through the down flow passage in the downwards direction in passing to the discharge outlet, the down flow passage being defined between a flue outer wall and the thermally conductive partition which defines an inner wall of the down flow passage.

Preferably the thermally conductive partition comprises an upper part of the heat exchanger wall whereby, when the burner is not operating, the heated zone comprises an upper part of the combustion products path in which heat comprises firstly residual heat from the combustion process and secondly, after a quiescent or standby period, radiant or convective heat yielded up from the stored water in the tank, the heat in the heated zone being conducted through the partition thereby maintaining the gases in the down flow passage at or approaching the temperature of the gases in the heated zone. Preferably the down flow passage in cross section is contoured to follow the profile of the heat exchanger wall. For example, the flue outer wall may be arcuate in horizontal cross section and may extend vertically along a substantial part of the height of the tank. The vertical extent of the down flow passage may be between 35% and 75% of the height of the heat exchanger wall.

In the preferred embodiment substantially the entire height of the down flow passage may be bounded on its inner side by the thermally conductive partition whereby heat transfer to gases in the down flow passage from the heated zone towards the lower end of the down flow passage adjacent and immediately above the discharge outlet is effective to enhance the heat trap effect.

The down flow passage may be substantially wider in the circumferential direction of the tank in horizontal section than the width of the outlet through which combustion products pass from the combustion products path to the down flow passage, thereby providing a substantial area of the thermally conductive partition for effective heat transfer therethrough during standby periods and enhancing an equalisation of gas temperatures on the inner and outer sides of the partition particularly towards the upper end of the down flow passage where the outlet is located.

Instead of the heated zone being part of the combustion products path, the heated zone may be a quiescent pocket where there is no significant operative flow of hot combustion products therethrough when the burner is operating but which is located so that hot combustion products reach and remain in the pocket after the burner ceases operation. The pocket may be located at an upper end of the water heater construction.

Alternatively the heated zone may comprise a quiescent pocket where combustion products do not reach but where heat from stored heated water can be yielded up to the pocket during quiescent or standby periods when the burner is not operating so as to be then transferred through the thermal transfer path to the down flow passage.

BRIEF DESCRIPTION OF THE DRAWINGS

Possible and preferred features of the present invention will now be described with particular reference to the accompanying drawings. However it is to be understood that the features illustrated in and described with reference to the drawings are not to be construed as limiting on the scope of the invention. In the drawings.

DETAILED DESCRIPTION OF EMBODIMENTS

Figure 1:
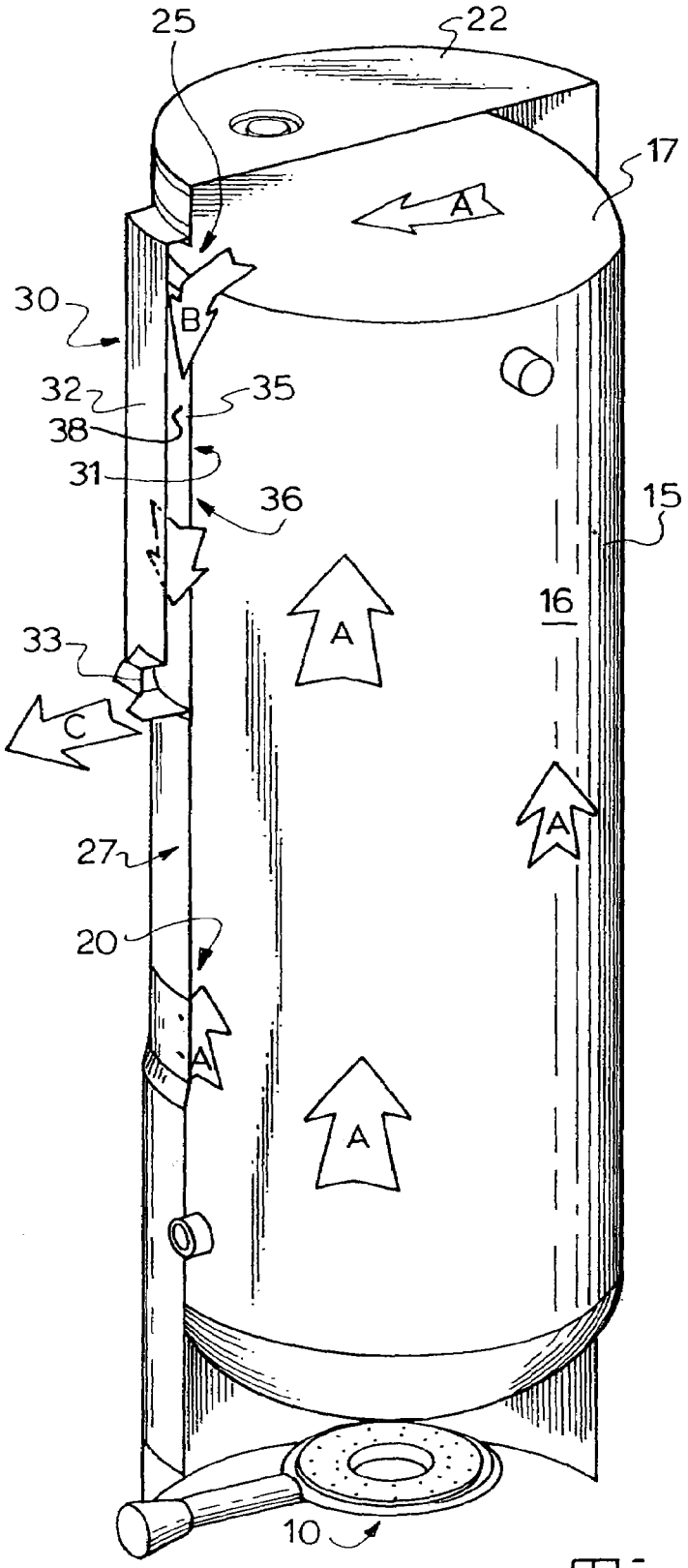
FIG. 1 is a perspective part sectional view of a water heater according to a first embodiment of the present invention.

In the first embodiment of FIGS. 1 to 4, the water heater includes a burner 10 which ignites under thermostat control when water in the tank 15 is below a target temperature. Combustion products flow upwardly around the tank 15 through a combustion products path 20 where heat transfer to water in the tank occurs, the path 20 being defined between the outer wall 16 of the tank 15 and a surrounding heat exchanger wall 21, the flow of combustion products being indicated by the arrows A. Combustion products also flow across the top 17 of the tank 15. The combustion products pass through outlet 25 provided near the upper end of wall 21, and enter the flue 30—see arrows B. Other conventional components of such a water heater will be provided as understood in the field, e.g. cold water inlet to the tank, hot water outlet, safety valves, thermostat probe, and insulation around the outside of the heat exchanger wall 21 and across the top of the heat exchanger lid 22. During operation of the burner 10, the combustion products flow along the outside of the wall 16 of the tank 15 thereby heating the water in the tank and the combustion products or flue gases pass through the flue 30.

The flue 30 includes a down flow passage 31 which is not a part of the combustion products path 20 where heat transfer to water occurs. The combustion products flow through the passage 31 in the downwards direction from the combustion products path 20 in passing out through discharge outlet 33 (which preferably directs gases into a balanced flue arrangement—not shown)—see arrow C. The down flow passage 31 is defined between a flue outer wall 32 and a thermally conductive partition 35 defining the inner wall 38 of the passage 31. The partition 35 for example can be made of conductive metal sheet which is solid and has no perforations as shown. The partition 35 is adjacent a heated zone 36 of the water heater where stored heat of the water heater is available during quiescent or standby periods when the burner is not operating. The partition 35 between the heated zone 36 and the down flow passage 31 provides a heat transfer wall so that heat in the heated zone 36 has transfer path through the partition 35 to gases in the down flow passage 31. When the burner 10 is not operating, heat in the heated zone 36 which will comprise residual heat from the combustion process and, more significantly after a longer quiescent or standby period, radiant or convective heat yielded up from the stored water in the tank 15, will be conducted through the partition 35 thereby maintaining the gases in the down flow passage 31 at or approaching the temperature of the gases in the heated zone 36. This will assist or promote the functioning of the down flow passage 31 as a heat trap during quiescent or standby periods when the burner is not operating. Without this heat transfer through the partition 35, gases in the down flow passage 31 will become significantly cooler which will create some convective flows therein and will thereby promote heat loss.

The down flow passage 31 in the illustrated preferred embodiment is substantially wider (i.e. in the circumferential direction of the tank in horizontal section) than the width of the outlet 25 and preferably also the width of the discharge outlet 33. This provides a substantial area of the partition 35 for effective heat transfer therethrough during standby periods, thus enhancing an equalisation of gas temperatures on inner and outer sides of the partition 35, particularly towards the upper end of the down flow passage 31 where the outlet 25 is located. The equalisation of gas temperatures particularly between the upper end of the down flow passage 31 and in the immediately adjacent heated zone near the outlet 25 will improve the heat trap effect and hence reduce heat losses by convective flows arising in the down flow passage 31.

Figure 2:
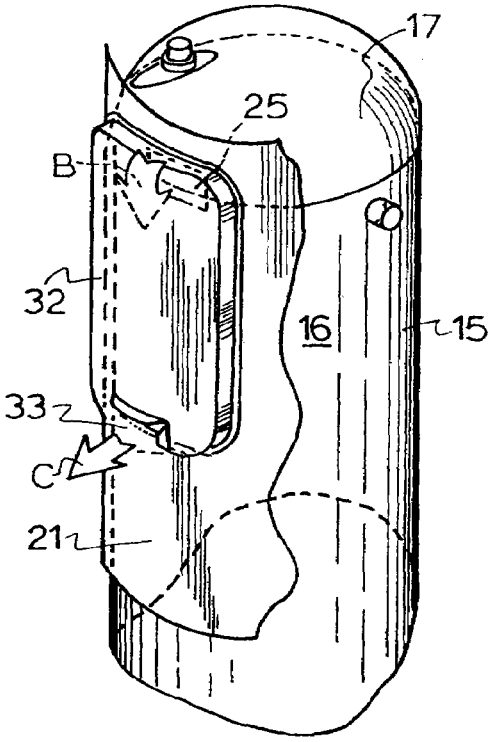
FIG. 2 is a perspective view similar to FIG. 1 but showing the down flow passage in its entirety.
Figure 3:
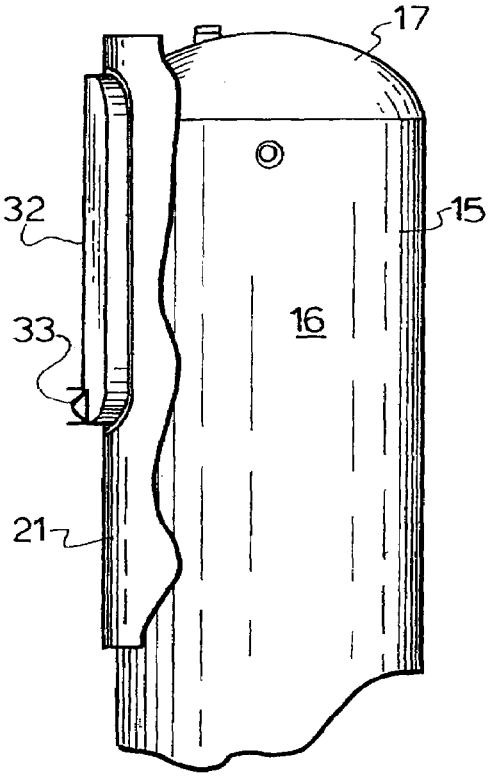
FIG. 3 is a side elevational, part cut-away, view of the components of FIG. 2.
Figure 4:
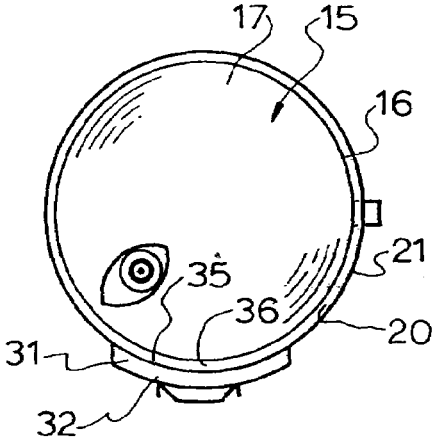
FIG. 4 is a top plan view of the tank, heat exchange wall, and down flow passage, of the first embodiment

To enable the large surface area of the partition to be achieved, the down flow passage 31 in cross section is contoured to follow the profile of the heat exchanger wall 21. In the illustrated preferred embodiment, the heated zone 36 is a part of the combustion products path adjacent the upper end of the outer wall 16 of the tank 15 and immediately below the outlet 25 through which combustion products flow from the combustion products path, including the heated zone 36, into the flue 30. As best seen in FIGS. 2 to 4, the flue outer wall 32 is arcuate in horizontal cross section and extends vertically along a substantial part of the height of the tank. The vertical extent of the down flow passage may be between about 35% and 75% of the height of the heat exchanger wall 21. The top end of the outer wall 32 is located at or slightly above the top end of the outer wall 16 of the tank 15 and extends downwardly therefrom.

Preferably substantially the entire height of the down flow passage is bounded on its inner side by the thermally conductive partition 35. It is believed that heat transfer to the gases in the down flow passage 31 from the heated zone 36 towards the lower end of the down flow passage 31, i.e. adjacent and immediately above the discharge outlet 33, may be particularly effective in enhancing the heat trap effect. The provision of the thermally conductive partition 35 even in the vicinity of the discharge outlet 33 may be thought to be poor thermodynamic design encouraging undesirable heat loss from the water heater through the discharge outlet 33, but the applicant believes that the enhancement of the heat trap effect may be more significant than any such heat loss, so that heat transfer into the down flow passage 31 even in this lower zone is desirable.

The flue outer wall 32 may be formed of any suitable material, e.g. pressed metal (e.g. aluminium) or suitable plastics material, and may be affixed to or pressed against the cylindrical outside face of the heat exchanger wall 21 in any convenient manner. Insulation material (not shown in FIGS. 1-4) would be provided around the outside of the flue outer wall 32, and as mentioned earlier, around the wall 21 and across the lid 22.

Figure 5:
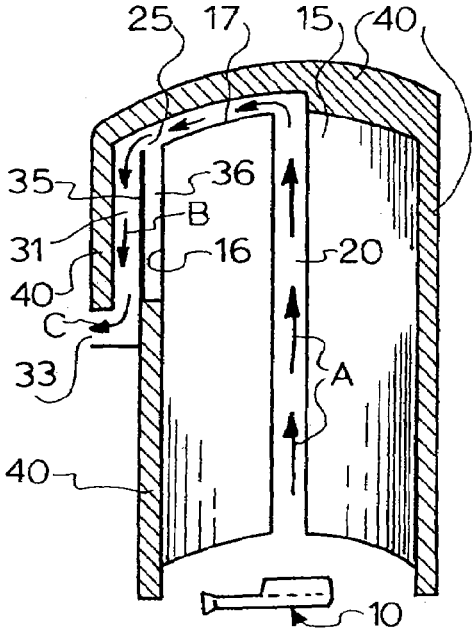
FIG. 5 is a schematic sectional view of another embodiment of a water heater with a central passage through the water tank for combustion products and embodying the present invention.

In the second embodiment illustrated schematically in FIG. 5, the burner 10 in operation creates hot combustion products which flow upwardly through the combustion products path 20 through the centre of the tank 15. During burner operation, the combustion products flow as indicated by the arrows A across the top 17 of the tank through the outlet 25 and thence though the down flow passage 31 (arrows B) and then though the discharge outlet 33 (arrow C). There is a heated zone 36 adjacent the tank 15 and a thermally conductive partition 35 forming an inside wall 38 of the down flow passage 31 and outside wall of the heated zone 36. When the burner 10 is not operating and the water heater is in quiescent or standby mode, radiant and convective heat from the water in the tank 15 passes into the heated zone 36 and will transfer thence though the partition 35 to heat the gases in the down flow passage 31. This will create or enhance a heat trap effect resisting down flow or convective flows of gases in the passage 31 and hence resisting heat losses from the water heater. Insulation 40 is schematically illustrated for retarding heat loss though other areas of the water heater.

It will be seen from the preceding description that the preferred embodiments of the present invention can provide improved energy efficiency by enhancing or promoting the heat trap when the water heater is in standby mode without the burner operating. It is believed that the major reason for the improved energy efficiency is that heat loss out of the flue passage during standby is reduced because the hot gas in the heated zone, which in the first embodiment is part of the combustion products path within the heat exchanger, particularly from radiation and heat transfer from the water tank after a period in standby mode, is reduced from travelling out of the flue passage because the flue passage gases are heated via the common panel or partition between the flue down flow passage and the heat exchanger wall. The heat trap effect is believed enhanced particularly by providing this heat transfer through the common wall or partition in the lower portion of the flue passage in the vicinity of the flue discharge outlet. By means of this construction, the gases particularly at the upper end of the flue down flow passage and internally adjacent the interconnecting outlet hole from the combustion products path into the flue are substantially equalised in temperature.

Because of the curved construction of the down flow passage of the flue to follow the outside profile of the heat exchanger wall around a substantial arc (e.g. 60° to 90°), there can be a reduction in front to rear depth of the water heater. The avoidance of a layer of insulation between the heat exchanger wall and the down flow passage also enables the front to back depth of the water heater to be reduced. For a water heater for outdoor installation, the heater can have less stand off depth from the side of a house than at present comparable water heaters. The down flow passage can be formed of a single panel defining its outer wall and side walls because its inside wall is defined by the outer face of the heat exchanger wall—this can save some material and reduce costs of manufacture.

It is to be understood that various alterations, modifications and/or additions may be made to the features of the possible and preferred embodiment(s) of the invention as herein described without departing from the spirit and scope of the invention as defined in the claims.

The invention claimed is:

1. A water heater which in use is supplied with water to be heated, in which the supplied water is heated, and which stores heated water to be drawn therefrom, the water heater including:

a burner for burning a fuel such as a fuel gas, a combustion products path through which combustion products from the burner flow and transfer heat to the water which is in use supplied to the water heater and which is to be drawn from the water heater, a heated zone where heat within the water heater is available during periods when the burner is not operating, a flue downstream of said combustion products path and including a down flow passage leading to a discharge outlet, the combustion products flowing in use in a downwards direction after entering the flue from the combustion products path through the down flow passage in passing to the discharge outlet, and wherein the down flow passage has a heat transfer wall which transfers heat from the heated zone to gases in the down flow passage when the burner is not operating, thereby promoting a heat trap effect in the down flow passage.

2. A water heater which in use is supplied with water to be heated, in which the supplied water is heated, and which stores heated water to be drawn therefrom, the water heater including:

a burner for burning a fuel such as a fuel gas, a combustion products path though which combustion products from the burner flow and transfer heat to the water which is in use supplied to the water heater and which is to be drawn from the water heater, a heated zone where heat within the water heater is available during periods when the burner is not operating, a flue downstream of said combustion products path and including a down flow passage leading to a discharge outlet, the combustion products flowing in use in a downwards direction after entering the flue from the combustion products path through the down flow passage in passing to the discharge outlet, and wherein the down flow passage has a heat transfer wall which transfers heat from the heated zone to gases in the down flow passage when the burner is not operating, thereby promoting a heat trap effect in the down flow passage, and wherein the heat transfer wall comprises a thermally conductive partition located between the heated zone and the down flow passage so that heat in the heated zone transfers though the partition to gases in the down flow passage when the burner is not operating.

3. A water heater as claimed in claim 2 wherein the heated zone is part of the combustion products path so that the combustion products flow though the heated zone when the burner is operating and where heat exchange from combustion products to the water occurs.

4. A water heater which in use is supplied with water to be heated, in which the supplied water is heated, and which stores heated water to be drawn therefrom, the water heater including:

a burner for burning a fuel such as a fuel gas, a combustion products path though which combustion products from the burner flow and transfer heat to the water which is in use supplied to the water heater and which is to be drawn from the water heater, a heated zone where heat within the water heater is available during periods when the burner is not operating, the heated zone being part of the combustion products path so that the combustion products flow through the heated zone when the burner is operating and where heat exchange from combustion products to the water occurs, a flue including a down flow passage leading to a discharge outlet, the combustion products flowing in use in a downwards direction after entering the flue from the combustion products path through the down flow passage in passing to the discharge outlet, and wherein the down flow passage has a heat transfer wall which transfers heat from the heated zone to gases in the down flow passage when the burner is not operating, thereby promoting a heat trap effect in the down flow passage, wherein the heat transfer wall comprises a thermally conductive partition located between the heated zone and the down flow passage so that heat in the heated zone transfers through the partition to gases in the down flow passage when the burner is not operating, and wherein the water heater includes a water tank and the burner is located at or beneath the bottom of the tank so that combustion products flow upwardly around the tank though the combustion products path where heat transfer to water in the tank occurs, the combustion products path being defined between an outer wall of the tank and a surrounding heat exchanger wall, the water heater further including an outlet near an upper end of the heat exchanger wall and through which combustion products pass from the combustion products path before entering the down flow passage of the flue whereby, during operation of the burner, the combustion products flow along the outside of the wall of the tank thereby heating water in the tank and the combustion products pass through the outlet and flow into and though the down flow passage in the downwards direction in passing to the discharge outlet, the down flow passage being defined between a flue outer wall and the thermally conductive partition which defines the heat transfer wall of the down flow passage.

5. A water heater as claimed in claim 4 wherein the thermally conductive partition comprises an upper part of the heat exchanger wall whereby, when the burner is not operating, the heated zone comprises an upper part of the combustion products path in which heat comprises firstly residual heat from the combustion process and secondly, after a quiescent or standby period, radiant or convective heat yielded up from the stored water in the tank, the heat in the heated zone being conducted though the partition thereby maintaining the gases in the down flow passage at or approaching the temperature of the gases in the heated zone.

6. A water heater as claimed in claim 5 wherein the down flow passage in cross section is contoured to follow the profile of the heat exchanger wall.

7. A water heater as claimed in claim 6 wherein the flue outer wall is arcuate in horizontal cross section and extends vertically along a substantial part of the height of the tank.

8. A water heater as claimed in claim 7 wherein the vertical extent of the down flow passage is between 35% and 75% of the height of the heat exchanger wall.

9. A water heater as claimed in claim 5 wherein substantially the entire height of the down flow passage is bounded on its inner side by the thermally conductive partition whereby heat transfer to gases in the down flow passage from the heated zone towards the lower end of the down flow passage adjacent and immediately above the discharge outlet is effective to enhance the heat trap effect.

10. A water heater as claimed in claim 4 wherein the down flow passage is substantially wider in the circumferential direction of the tank in horizontal section than the width of the outlet though which combustion products pass from the combustion products path to the down flow passage, thereby providing a substantial area of the thermally conductive partition for effective heat transfer therethrough during standby periods and enhancing an equalisation of gas temperatures on the inner and outer sides of the partition particularly towards the upper end of the down flow passage where the outlet is located.

11. A water heater which in use is supplied with water to be heated, in which the supplied water is heated, and which stores heated water to be drawn therefrom, the water heater including:

a burner for burning a fuel such as a fuel gas, a combustion products path through which combustion products from the burner flow and transfer heat to the water which is in use supplied to the water heater and which is to be drawn from the water heater, a heated zone where heat within the water heater is available during periods when the burner is not operating, a flue including a down flow passage leading to a discharge outlet, the combustion products flowing in use in a downwards direction after entering the flue from the combustion products path through the down flow passage in passing to the discharge outlet, and wherein the down flow passage has a heat transfer wall which transfers heat from the heated zone to gases in the down flow passage when the burner is not operating, thereby promoting a heat trap effect in the down flow passage, wherein the heat transfer wall comprises a thermally conductive partition located between the heated zone and the down flow passage so that heat in the heated zone transfers through the partition to gases in the down flow passage when the burner is not operating, and wherein the heated zone is a quiescent pocket where there is no significant operative flow of hot combustion products therethrough when the burner is operating but which is located so that hot combustion products reach and remain in the pocket after the burner ceases operation.

12. A water heater as claimed in claim 11 wherein the pocket is located at an upper end of the water heater construction.

13. A water heater which in use is supplied with water to be heated, in which the supplied water is heated, and which stores heated water to be drawn therefrom, the water heater including:

a burner for burning a fuel such as a fuel gas, a combustion products path through which combustion products from the burner flow and transfer heat to the water which is in use supplied to the water heater and which is to be drawn from the water heater, a heated zone where heat within the water heater is available during periods when the burner is not operating, a flue including a down flow passage leading to a discharge outlet, the combustion products flowing in use in a downwards direction after entering the flue from the combustion products path through the down flow passage in passing to the discharge outlet. and wherein the down flow passage has a heat transfer wall which transfers heat from the heated zone to gases in the down flow passage when the burner is not operating, thereby promoting a heat trap effect in the down flow passage, wherein the heat transfer wall comprises a thermally conductive partition located between the heated zone and the down flow passage so that heat in the heated zone transfers through the partition to gases in the down flow passage when the burner is not operating, and wherein the heated zone comprises a quiescent pocket where combustion products do not reach but where heat from stored heated water can be yielded up to the pocket during quiescent or standby periods when the burner is not operating so as to be then transferred through the heat transfer wall to the down flow passage.

* * * * *